US008079570B2

(12) United States Patent
Ruan

(10) Patent No.: US 8,079,570 B2
(45) Date of Patent: Dec. 20, 2011

(54) WINDING, SECURING AND POSITIONING MECHANISM FOR A COME-ALONG

(75) Inventor: Bu Qin Ruan, Zhejiang (CN)

(73) Assignee: Zhejiang Topsun Logistic Control Co., Ltd, Yuhuan District Tai Zhou (CN)

( * ) Notice: Subject to any disclaimer, the term of this patent is extended or adjusted under 35 U.S.C. 154(b) by 0 days.

(21) Appl. No.: 12/220,814

(22) Filed: Jul. 28, 2008

(65) Prior Publication Data

US 2009/0127529 A1 May 21, 2009

Related U.S. Application Data

(63) Continuation of application No. 10/906,700, filed on Apr. 2, 2005, now Pat. No. 7,513,452.

(30) Foreign Application Priority Data

Apr. 6, 2004 (CN) ..... 2004 2 0021883 U

(51) Int. Cl.
*B66D 1/30* (2006.01)

(52) U.S. Cl. ..... 254/371; 254/372; 254/373; 242/613; 242/602.2

(58) Field of Classification Search ..... 254/221, 254/333, 371–373, 383, 375, DIG. 14; 242/579, 242/587.1–587.3, 586, 903, 610, 613, 602.2, 242/125.1–125.3
See application file for complete search history.

(56) References Cited

U.S. PATENT DOCUMENTS

| | | | | | |
|---|---|---|---|---|---|
| 823,401 | A * | 6/1906 | Ferris | 242/586.2 |
| 1,767,938 | A * | 6/1930 | Monnier et al. | 242/586.1 |
| 2,019,512 | A * | 11/1935 | Stahl | 242/396.4 |
| 2,053,976 | A * | 9/1936 | Stahl | 254/375 |
| 2,124,129 | A * | 7/1938 | Therolf | 254/288 |
| 2,151,837 | A * | 3/1939 | Burke | 24/115 R |
| 2,212,798 | A * | 8/1940 | Sole | 242/603 |
| 2,329,943 | A * | 9/1943 | Robins | 242/587.1 |
| 2,501,253 | A * | 3/1950 | Anglemyer | 254/369 |
| 2,973,941 | A * | 3/1961 | Lunde | 242/388.5 |
| 3,272,454 | A * | 9/1966 | Lane et al. | 242/602.2 |
| 3,836,123 | A * | 9/1974 | Bausenbach et al. | 242/157.1 |
| 4,235,420 | A * | 11/1980 | Ross et al. | 254/218 |
| 4,534,522 | A * | 8/1985 | Spence | 242/172 |
| 4,625,947 | A * | 12/1986 | Denman et al. | 254/323 |
| 4,787,602 | A * | 11/1988 | Pidgeon | 256/23 |
| 5,085,378 | A * | 2/1992 | Guttler | 242/172 |
| 5,639,043 | A * | 6/1997 | Baird | 242/419.4 |
| 5,660,343 | A * | 8/1997 | Schippers et al. | 242/172 |
| 5,664,766 | A * | 9/1997 | Baziuk | 254/375 |
| 5,890,674 | A * | 4/1999 | Major | 242/587 |
| 5,957,433 | A * | 9/1999 | Fujikawa et al. | 254/371 |
| 6,199,617 | B1 * | 3/2001 | Schweiss | 160/193 |
| 6,719,241 | B2 * | 4/2004 | Golden | 242/586.1 |
| 6,981,670 | B2 * | 1/2006 | Harrington | 242/402 |

(Continued)

*Primary Examiner* — Emmanu M Marcelo

(74) *Attorney, Agent, or Firm* — Bergman & Song, LLP; Michael Bergman

(57) ABSTRACT

A come-along for pulling loads includes a rope winding mechanism that enables the rope to be wound and fed out smoothly. The rope winding mechanism includes a positioning hole that reduces the angle between the secured end of the rope and an axial tube about which the rope is wound. The come-along also includes a rope securing mechanism. The secured end of the rope has a seal head that fits through an installation hole and rests against the positioning hole. A helical slot around the axial tube enables the rope to wind evenly.

19 Claims, 10 Drawing Sheets

U.S. PATENT DOCUMENTS

| | | | | |
|---|---|---|---|---|
| 7,108,248 | B2 * | 9/2006 | Winter et al. | 254/371 |
| 2002/0104918 | A1 * | 8/2002 | Zacharias | 242/587.1 |
| 2003/0010858 | A1 * | 1/2003 | Wier | 242/376 |
| 2005/0103921 | A1 * | 5/2005 | Winter et al. | 242/587.1 |
| 2009/0127529 | A1 * | 5/2009 | Ruan | 254/369 |

* cited by examiner

WINDING, SECURING AND POSITIONING MECHANISM FOR A COME-ALONG

CROSS-REFERENCES

The present application is a continuation of U.S. patent application Ser. No. 10/906,700 filed on Apr. 2, 2005 now U.S. Pat. No. 7,513,452 the disclosure of which is herewith incorporated by reference in its entirety, and which in turn claims priority under the Paris Convention for the Protection of Industrial Property to Chinese Patent Application Number 200420021883-6 filed in the People's Republic of China on Apr. 6, 2004, and to Chinese Patent Application Number 200410067190.5 filed in the People's Republic of China on Oct. 15, 2004 the disclosures of which are herewith incorporated by reference in their entirety.

FIELD OF THE INVENTION

The present invention relates to mechanical technologies and in particular to a tool for manipulating loads.

BACKGROUND

When pulling heavy items, when towing vehicles or when setting up a tent, a come-along is often useful. A come-along is desirable in these situations because it is a simple mechanism, is easy to transport and provides great pulling force.

A conventional come-along 50 is shown in FIGS. 1-5. FIG. 1 is a side partial-cutaway view of a conventional come-along 50. FIG. 2 is a front view of the conventional come-along 50. The come-along 50 has a main body 5 with a first hook 52 attached at a first end of the main body 5. The main body 5 includes an axial tube 1. The main body 5 includes a rope 3 or cable wound around the axial tube 1. A second hook 7 is connected to an end of the rope 3.

In operation, the second hook 7 is hooked to the load to be pulled such as a heavy item or a vehicle. The tightening and release of the second hook 7 is realized through the winding of the rope 3 to the axial tube 1. This operation often results in a messy or loose winding of the rope 3, as the rope 3 will typically be wound around the axial tube 1 in more than two layers. Once the rope 3 is pulled, it is possible that the outermost layer of the rope 3 coiled on the axial tube 1 will be tightened. When the outermost layer of the rope 3 tightens, it typically sinks under windings of the rope 3 of the inner layers. This creates difficulty in pulling the rope out of the layers of the loosely wound ropes, even resulting in breakage of the rope if the rope is pulled too hard.

FIG. 3 shows a top view of the axial tube 1 with a winding of rope 3 of the conventional come-along of FIG. 1. One end of the rope 3 is inserted and clamped into a positioning hole on the axial tube 1 to achieve secure connection. The inner end of the rope 3 is typically bent about 90 degrees coming out from the positioning hole in order to be wound onto the axial tube 1. Due to the fact that the rope is typically made of steel and accordingly possesses certain rigidity, there exists a perturbation 16, or bulge, around the bend. Moreover, this perturbation is generally telegraphed through subsequent layers of rope that are wound around the axial tube 1. This causes an off-roundness of the rope winding that results in an unevenness of the tightness of the rope. As a consequence, the ejection force of the rope will become uneven or the rope might get stuck on the axial tube which diminishes the usefulness of the come-along.

FIG. 4 is a side view of the conventional axial tube 1 with windings of the rope 3 and a clamp 60. FIG. 5 is a side view of the conventional axial tube 1 without rope 3. As shown in FIG. 4, the inner end of the rope 3 is clamped to the positioning hole that is on the axial tube 1. This is not a very secure fixturing method, as the rope is often pulled off the axial tube 1 after all the windings have been released. This affects the normal usage of the come-along and creates a certain risk of danger because the rope being pulled off the axial tube also results in a release of the load connected to the come-along.

For the foregoing reasons, there is a need for an improved come-along.

SUMMARY

The present invention is directed to a rope-winding mechanism for a come-along. The rope winding mechanism reduces the bulge present on the axial tube in conventional come-alongs. The rope winding mechanism of the present invention also provides a more secure attachment to the axial tube. The invention is realized through the following features: in the rope winding mechanism for the come-along, a concave, helical slot is devised. The helical slot extends from the positioning hole all along the surface of the axial tube in the orientation of the rope winding direction. Viewed in cross section, the distance between the adjacent slots of the axial tube is the same as the diameter of the rope or somewhat larger. This mechanism enables the rope to fall into the slots in an orderly fashion to make the rope arrangement neat and tight, thus reducing the possibility of an outer layer rope falling into inner layers of rope.

A rope securing mechanism is located on the axial tube used for winding the rope. The axial tube includes a positioning hole. An inner end of the rope is embedded into the positioning hole. This design possesses the following features: the aforementioned positioning hole is located on an outer curved surface of a Y-shaped axial tube cross section. The positioning hole opening is located on a side surface of the Y-shaped curved-surface, which enables the rope exiting the positioning hole to be wound around the axial tube in an almost-tangent angle to the axial tube. In addition, the rope is situated into the helical slots, which eliminates the perturbation, or bulge, of the rope, resulting in an even force on the rope during use.

In the aforementioned securing mechanism for the come-along, an installation hole is connected to the positioning hole located on the axial tube. The dimension of the installation hole is greater than that of the positioning hole. A seal head is also on the end of the rope and the seal head is held in the positioning hole. The rope end with the seal head can go through the installation hole, but not the positioning hole. Thus the inner end of the rope can go through the installation hole and be inserted into the axial tube, and then slid into the positioning hole for a secure fixturing between the rope and the axial tube.

In the aforementioned rope securing mechanism for the come-along, a stopper plate is located between the installation and positioning holes, which is part of the axial tube. When the inner end of the rope is inserted into the installation hole and then slid into the positioning hole, the stopper plate is bent to allow the passing of the rope. The stopper plate is then pressed down after the installation of the rope is complete to prevent the rope from sliding back to the installation hole.

The aforementioned rope securing mechanism for the come-along has the following features: a rope securing latch is situated on the axial tube that will be securely connected onto the axial tube. The rope securing latch has an "n" shape and has a press-latch part adapted to be pressed around the rope that has already been wound several loops on the axial tube.

In the aforementioned rope securing mechanism, the cross-section of the press-latch is in an "n" shape. Typically, the press-latch is pressed into the axial tube on the rope that has already been wound with 1-8 loops around the axial tube.

In the aforementioned rope securing mechanism for the come-along, the stated rope securing latch is connected to the rectangular slots on the axial tube through the elasticity of the triangular latch and the openings under the latch.

Through the rope securing latch to secure the several loops of the rope onto the axial tube, the normal usage of the come-along can be ensured as the rope securing latch prevents the complete unwinding of the rope. When the rope is pulled to the securing latch, the rope is unable to pull any further. Due to the fact that the rope securing latch is located several loops from the rope inner end, the rope has a greater winding force. The fixturing between the rope and the axial tube makes it difficult for the rope to detach from the axial tube, thus improving the safety and reliability of the come-along.

The present invention together with the above and other advantages may best be understood from the following detailed description of the embodiments of the invention illustrated in the drawings, wherein:

DRAWINGS

DETAILED DESCRIPTION

A come-along includes an improved rope-winding mechanism and rope-securing mechanism. The rope-winding mechanism enables the rope to be wound and unwound smoothly during operation of the come-along. The rope-securing mechanism also improves the winding of the rope of the come-along and prevents the rope from pulling off the come-along.

Figure 1:
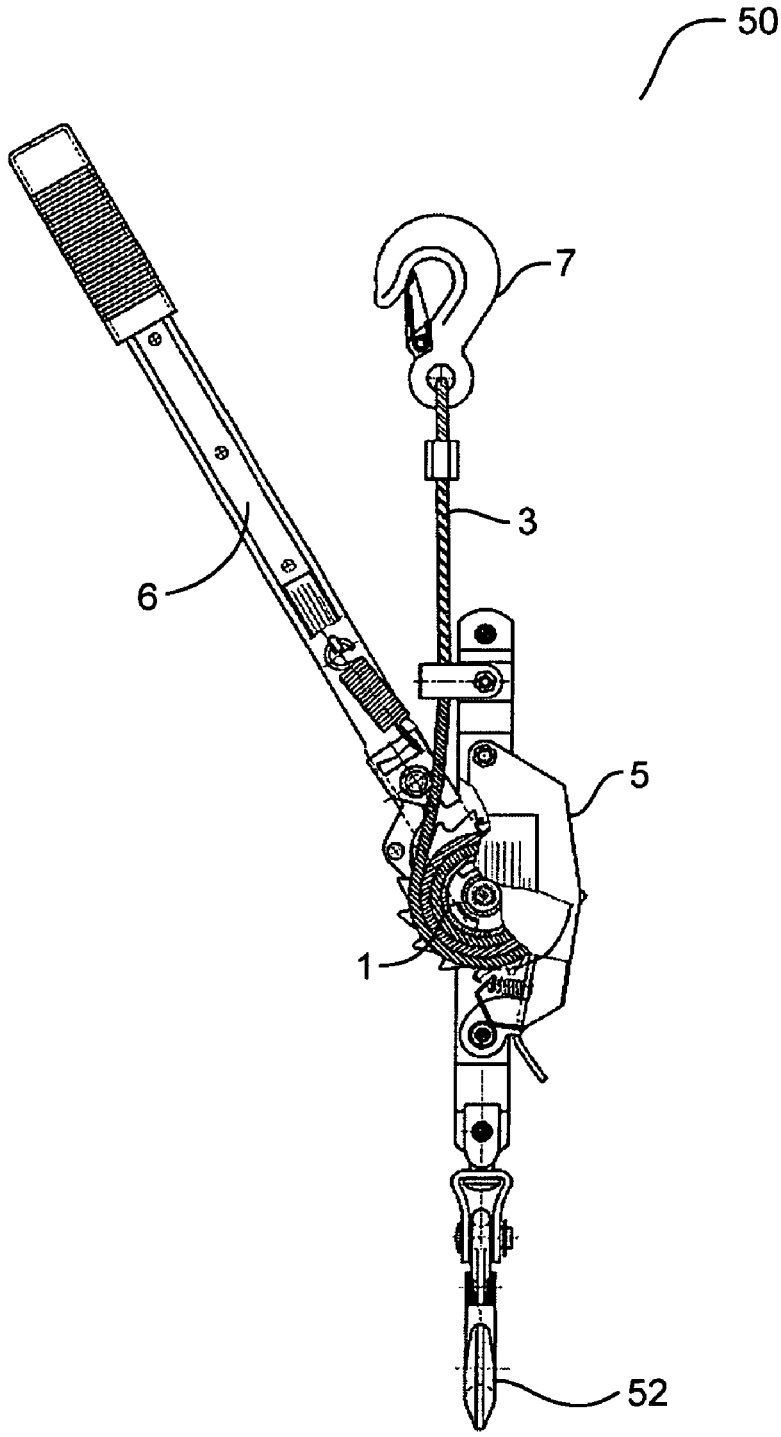
Fig. 1 (Prior Art)
FIG. 1 is a side partial cut-away view of a conventional come-along.
Figure 2:
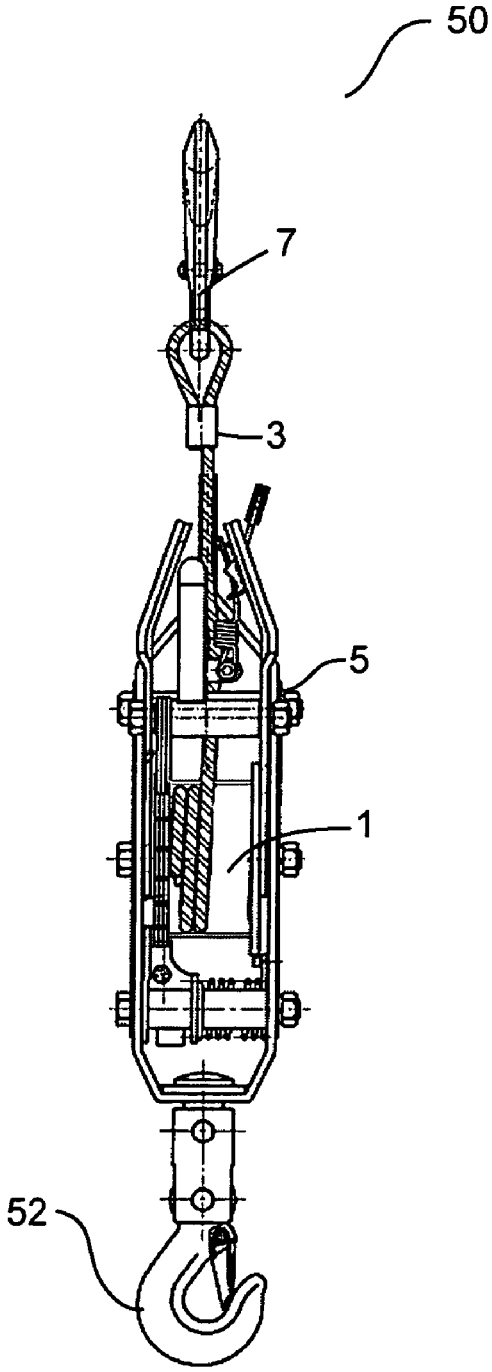
Fig. 2 (Prior Art)
FIG. 2 is a front view of the conventional come-along of FIG. 1.
Figure 3:
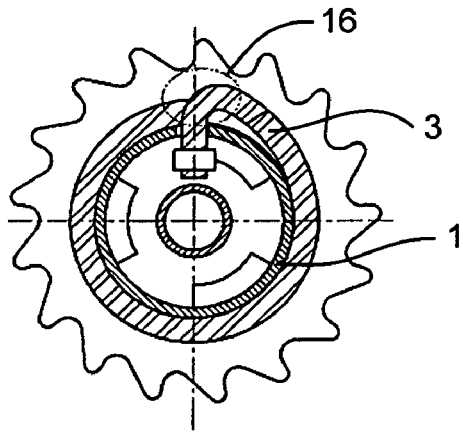
Fig. 3 (Prior Art)
FIG. 3 is a top view of a conventional axial tube of the come-along of FIGS. 1 and 2.
Figure 4:
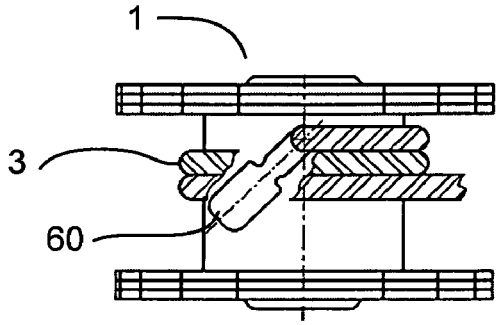
Fig. 4 (Prior Art)
FIG. 4 is a side view of the conventional axial tube of FIG. 3 including windings of rope.
Figure 5:
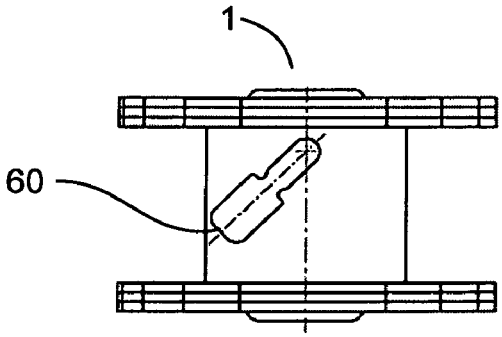
Fig. 5 (Prior Art)
FIG. 5 is a side view of the conventional axial tube of FIG. 3 without windings of rope.
Figure 6:
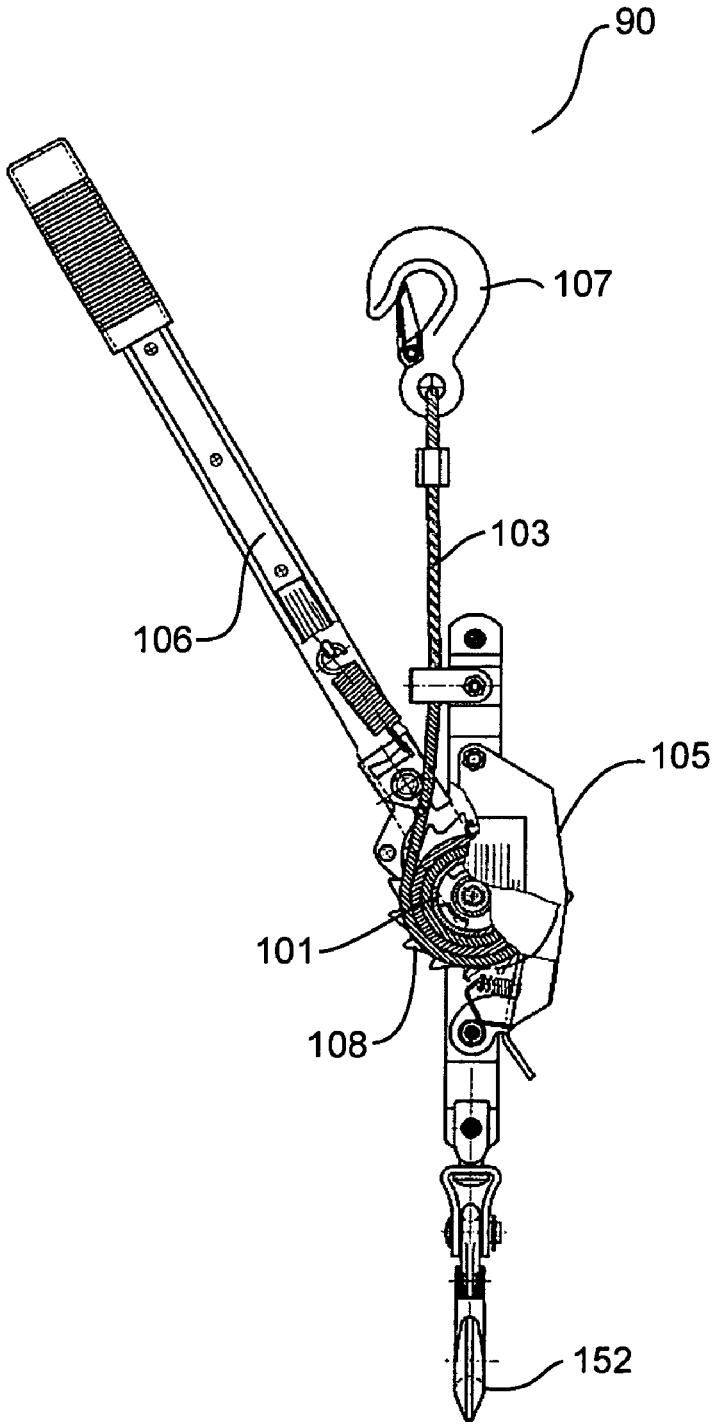
FIG. 6 is a side partial cut-away view of a come-along according to principles of the invention.
Figure 7:
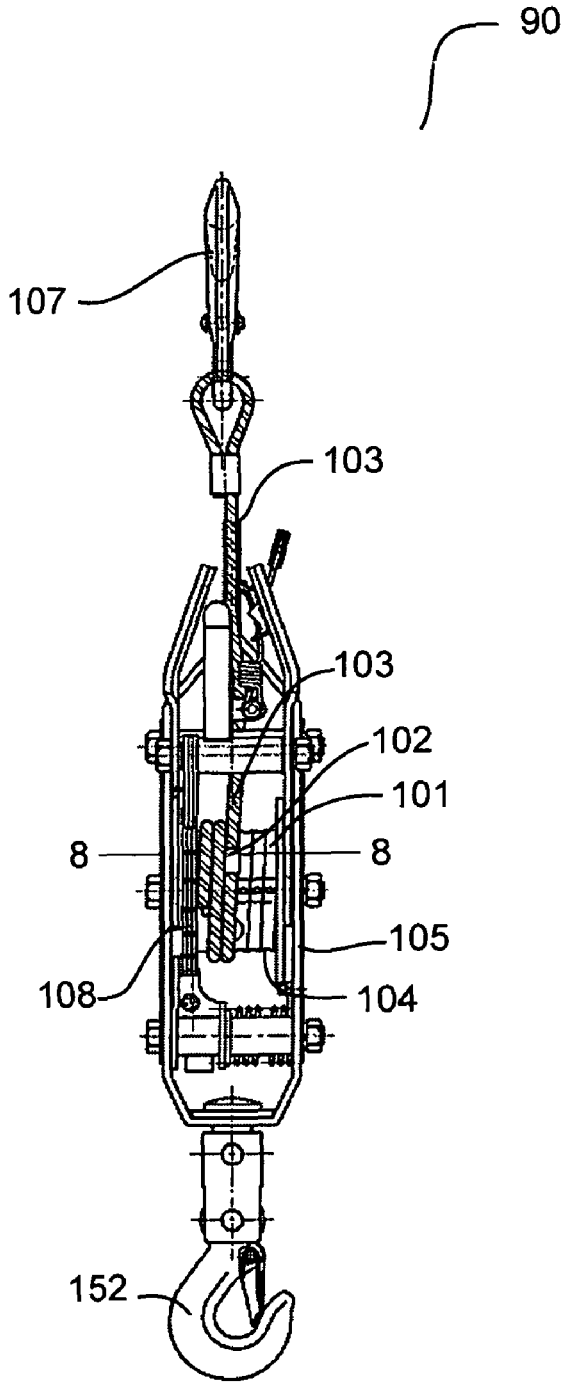
FIG. 7 is a front view of the come-along of FIG. 6.

FIG. 6 is a side partial cut-away view of a come-along according to principles of the invention. FIG. 7 is a front view of the come-along according to principles of the invention. The come-along 90 includes a main body 105, a handle 106 (as shown in FIG. 6), a rope 103, a first hook 107 and a second hook 152. The axial tube 101 and ratchet 108 are on the main body 105. The axial tube 101 and ratchet 108 are securely connected together. Turning the handle 106 turns the ratchet 108, thereby winding the rope 103 onto axial tube 101.

When using the come-along 90, the rope 103 is pulled out and the first hook 107 is hooked onto a heavy item or to a vehicle. The handle 106 is then turned to tighten the rope 103 winding on the axial tube 101. According to principles of the invention, the axial tube includes concave helical slots 104.

Figure 8:
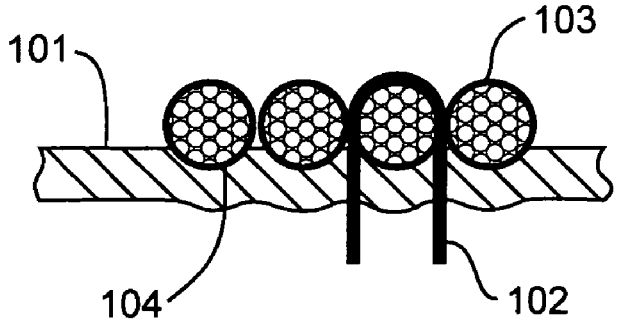
FIG. 8 is a cross-section view at A-A of windings of rope on the axial tube of FIG. 7.
Figure 9:
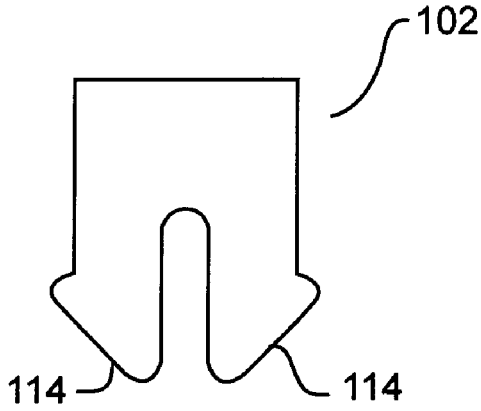
FIG. 9 is a front view of the rope securing latch of the present invention.
Figure 10:
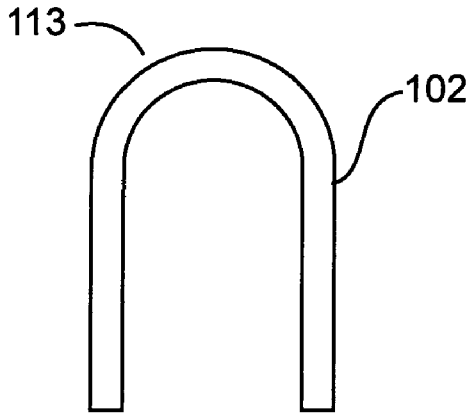
FIG. 10 is a side view of the rope securing latch of the present invention.
Figure 11:
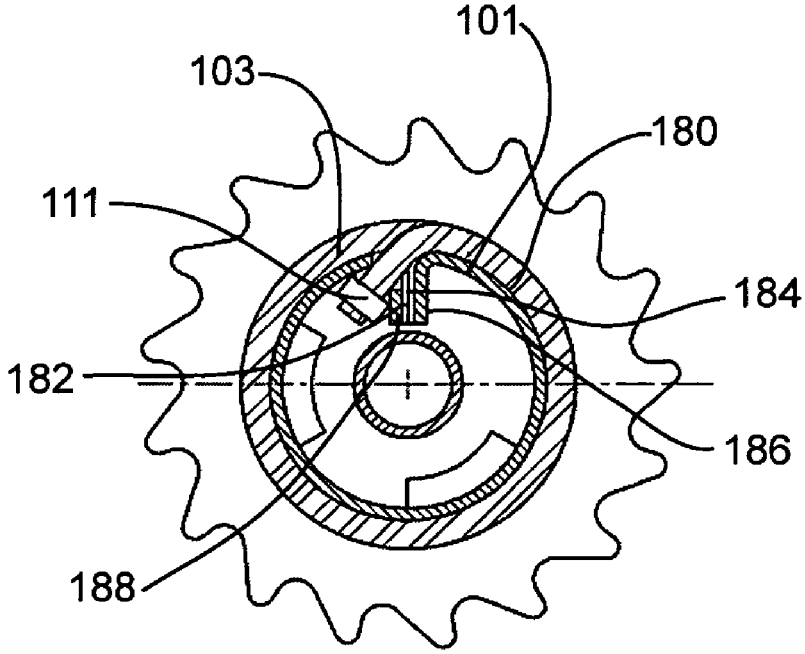
FIG. 11 is a top view of the axial tube of the present invention.
Figure 12:
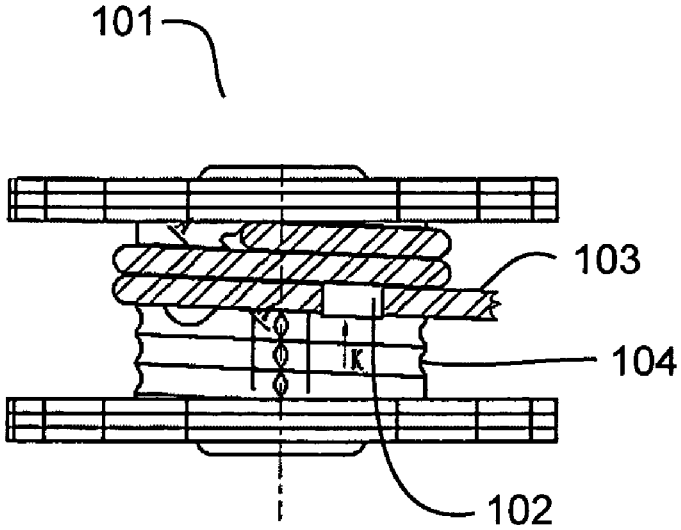
FIG. 12 is a side view of the axial tube of the present invention.
Figure 13:
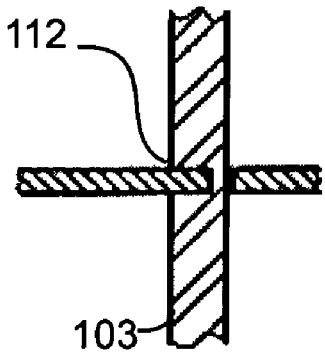
FIG. 13 shows the stopper plate of the present invention in a pressed-down state.
Figure 14:
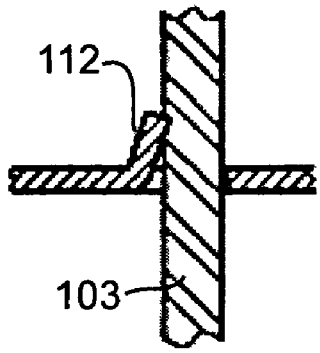
FIG. 14 shows the stopper plate of the present invention in a bent state.
Figure 15:
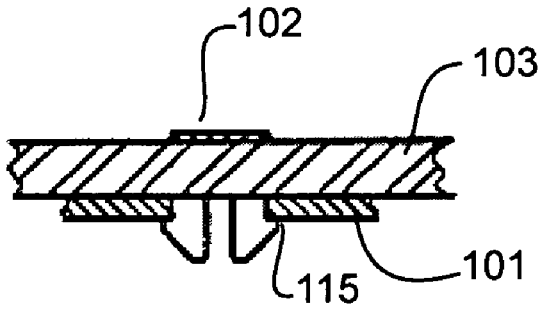
FIG. 15 is a side cross-section view of the rope securing latch of the present invention in operation.
Figure 16:
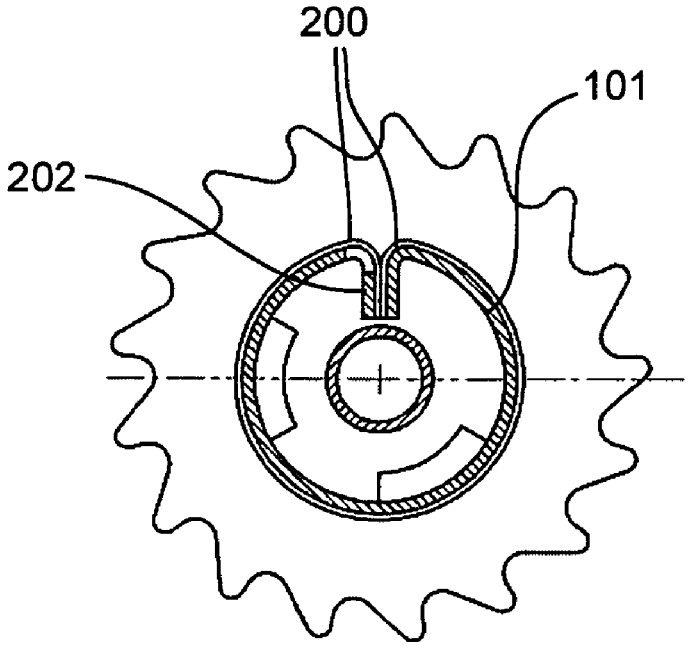
FIG. 16 is a top view of the axial tube of the present invention including an A-shaped curvature.
Figure 17:
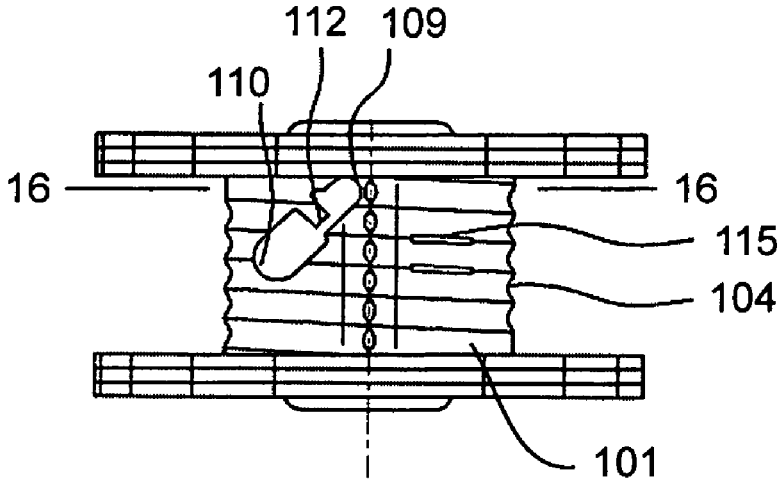
FIG. 17 is a side view of the axial tube including a rope securing mechanism of the present invention.
Figure 18A:
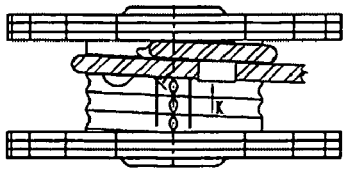
FIGS. 18A-18H show respective side views of an axial tube with respective numbers of turns of rope.
Figure 18B:
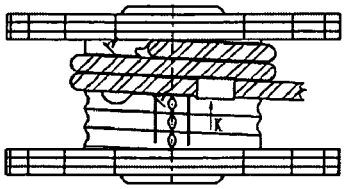
Figure 18C:
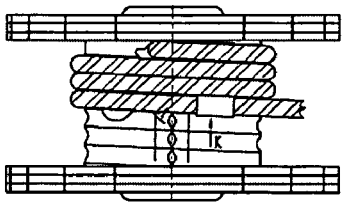
Figure 18D:
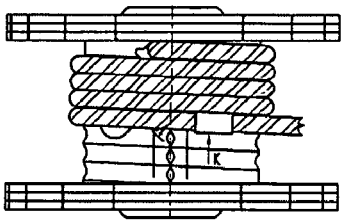
Figure 18E:
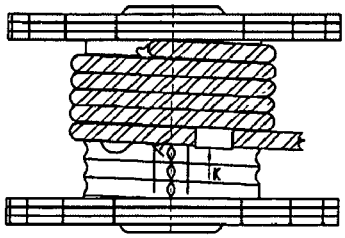
Figure 18F:
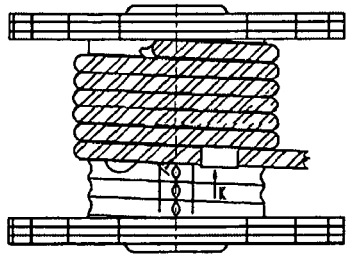
Figure 18G:
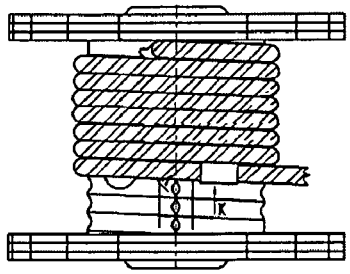
Figure 18H:
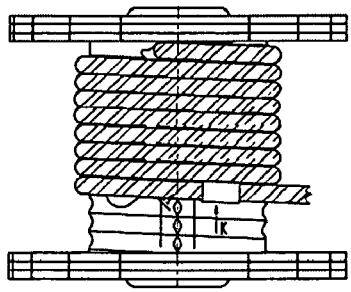

FIGS. 8-17 illustrate a rope winding mechanism and rope-securing mechanism of the present invention. FIG. 8 is a cross-section view at 8-8 of windings of rope on the axial tube including a rope winding mechanism according to principles of the invention. FIG. 9 is a front view of a rope securing latch 102 of the present invention. FIG. 10 is a side view of the rope securing latch 102 of the present invention including a pressing portion 113 that, in operation, presses on the rope 103. FIG. 11 is a top view of the axial tube 101 of the present invention. FIG. 12 is a side view of the axial tube of the present invention. FIG. 13 is an illustration of the stopper plate 112 in a pressed-down state and FIG. 14 is an illustration of the stopper plate 112 in a bent state according to principles of the invention. FIG. 15 is a side cross-section view of the rope securing latch in operation according to principles of the invention. FIG. 16 is a top view of the axial tube 101 including an A-shaped curvature. FIG. 17 is a side view of the axial tube including a rope securing mechanism of the present invention.

In the rope winding mechanism in FIG. 8, the surface of the axial tube 101 includes concave, helical slots 104 starting from a positioning hole 109 (shown in FIG. 17) along the winding direction of rope 103. A gap between the slots 104 is typically approximately the diameter of the rope 103 or slightly larger. The slots 104 can be made by such methods as injection molding, machining, or casting. The present invention is not limited to these manufacturing methods.

In the securing mechanism of the invention as shown in FIGS. 11-17, the positioning hole 109 is located on the curvature 200 of the Y-shaped cross section 202 (as identified, e.g., in FIG. 16) that is on the surface of axial tube 101. The positioning hole 109 located on curvature 200 orients the rope 103 exiting from the positioning hole 109 in an almost-tangent angle to the axial tube 101.

FIG. 11 shows a first outwardly facing circumferential surface portion 180 a second radial surface portion 182 and a third radial surface portion 184. As illustrated, the second radial surface portion 182 and third radial surface portion 184 each diverges substantially smoothly from a radial orientation to a circumferential orientation. Also shown are further radial surface portions 186 and 188. Radial surface portion 182, 184, 186 and 188 include respective surface regions disposed in substantially parallel spaced relation to one another.

In the rope securing mechanism of the invention as shown in FIG. 17, the installation hole 110 is on the aforementioned axial tube 101. The installation hole 110 is connected to positioning hole 109. The diameter of installation hole 110 is greater than the diameter of the positioning hole 109. A seal head 111 is on one end of the rope 103. The diameter of the seal head 111 is smaller than that of the installation hole 110 and larger than the diameter of the positioning hole 109. Thus the seal head 111 on rope 103 can be inserted into axial tube 101 through installation hole 110, and slid into the positioning hole 109. The diameter of the positioning hole 109 is smaller than that of the seal head 111, and thus the rope 103 stays attached to the axial tube 101.

In the rope securing mechanism in the invention as shown in FIGS. 16 and 17, a stopper plate 112 is located between the installation hole 110 and the positioning hole 109. The stopper plate 112 is part of the axial tube 101. Before the seal head 111 end of the rope 103 is inserted into the installation hole 110 and slid into positioning hole 109, the stopper plate 112 is bent to let the rope slide through. The stopper plate 112 is pressed down when the installation is complete to prevent rope 103 from sliding from positioning hole 109 back to installation hole 110. The positioning of the stopper plate 112 is shown in detail in FIGS. 13 and 14. In FIG. 13, the stopper plate 112 is shown in the pressed down state against the rope 103. In FIG. 14, the stopper plate 112 is shown in the bent (open) state enabling the rope 103 to slide past the stopper plate 112.

In the rope positioning mechanism shown in FIGS. 8-12 and 15, the press portion 113 on the rope securing latch 102 has a lateral cross-section having an "N" shape to match the cross-section profile of the rope to improve the attaching force between the rope 103 and the rope securing latch 102.

In the rope positioning mechanism according to principles of the invention as shown in FIGS. 12, 15, and 17, the rope securing latch 102 is securely attached to the rectangular slots 115 on the axial tube 101 through the elasticity of triangular latches 114. Typically, the rope securing latch 102 is made of a metallic material.

It is to be understood that the above-identified embodiments are simply illustrative of the principles of the invention. Various and other modifications and changes may be made by those skilled in the art which will embody the principles of the invention and fall within the spirit and scope thereof.

The invention claimed is:

1. A winch comprising:

a spool;

a captivator; and a substantially flexible tensile member, said substantially flexible tensile member being coupled to said spool at a first base portion of said tensile member, a second wrapped portion of said tensile member disposed longitudinally adjacent to said first base portion and being wrapped circumferentially about said spool, a surface region of said second wrapped portion being disposed substantially in contact with an external surface region of said spool, a third portion of said tensile member being slidingly coupled to said external surface region of said spool by said captivator, said captivator being connected at two ends thereof to a circumferential surface region of said spool, said two ends both being disposed adjacent to said third portion, so as to prevent an unwrapping of said second wrapped portion of said tensile member, and a fourth portion of said tensile member being adapted to be wrapped and unwrapped from about said spool under a tensile force, whereupon a frictional force between said surface region of said second wrapped portion and said external surface region of said spool opposes a portion of said tensile force to thereby reduce a load on said coupling between said spool and said first base portion.

2. A winch as defined in claim 1 wherein said first base portion of said tensile member comprises a first end of said tensile member.

3. A winch as defined in claim 1 wherein said captivator comprises a mechanical device having a first captivator portion and a second captivator portion, said first captivator portion being adapted to be coupled to said cable and said second captivator portion being adapted to be coupled to said spool.

4. A winch as defined in claim 3 wherein said second captivator portion, is adapted to be disposed within a recess disposed at the surface region of said spool.

5. A winch as defined in claim 3 wherein said first captivator portion comprises a substantially semi-circular surface region and said second captivator portion comprises a barbed detent.

6. A winch as defined in claim 1 wherein said substantially flexible tensile member comprises a rope.

7. A winch as defined in claim 6 wherein said rope comprises a wire rope.

8. A winch as defined in claim 1 further comprising a sprocket wheel, said sprocket wheel being substantially fixedly coupled to said spool for rotation of said spool.

9. A winch as defined in claim 8 further comprising a pawl, said pawl being adapted to control motion of said sprocket wheel.

10. A winch as defined in claim 1 wherein said circumferential wrapping of said second wrapped portion about said spool comprises a circumferential wrapping of the least about 360°.

11. A winch as defined in claim 1 wherein said circumferential wrapping of said second wrapped portion about said spool comprises a circumferential wrapping of the least about 720°.

12. A winch as defined in claim 1 wherein said circumferential wrapping of said second wrapped portion about said spool comprises a circumferential wrapping of greater than 1080°.

13. A tensioning device comprising:

a substantially pliable longitudinal member;

a bearing member having a circumferential external surface, said external surface being adapted to support a portion of a longitudinal member;

a first captivator, said first captivator being adapted to detain a first portion of said longitudinal member in substantially fixed proximity to said the circumferential external surface; and a second captivator, said second captivator being connected at opposite ends thereof to said circumferential external surface to detain a second portion of said longitudinal member in sliding proximity to said circumferential external surface, said first and second captivators being circumferentially separated from one another along a length of said longitudinal member so as to define a substantially captive portion of said longitudinal member between said first captivator and said second captivator.

14. A tensioning device as defined in claim 13 wherein said first captivator comprises a swage end.

15. A tensioning device as defined in claim 13 wherein said second captivator comprises a substantially U-shaped staple, said staple including a concave surface region, said concave surface region being adapted to slidingly interface with an external surface region of said longitudinal member.

16. A tensioning device as defined in claim 13 wherein said second captivator comprises a barbed detent portion, said barbed detent portion being adapted to be disposed within a slot in said external surface of said bearing member.

17. A tensioning device as defined in claim 13 wherein said external surface comprises a generally cylindrical surface including at least one substantially helical grooved region.

18. A method of coupling a tensile member to a spool comprising:

fastening a first end of said tensile member to said spool;

wrapping a first portion of said tensile member around a circumferential surface of said spool; and slidingly coupling a second portion of said tensile member to said spool by disposing a captivator over said second portion of said tensile member and disposing first and second barbs of said captivator within first and second slots of said circumferential surface, said second portion of said tensile member being disposed intermediate between said first end of said tensile member and a second end of said tensile member.

19. A method of coupling a tensile member to a spool as defined in claim 18 further comprising:

wrapping a third portion of said tensile member about a circumferential surface of said spool, said third portion of said tensile member being disposed between said second portion of said tensile member and said second end; and unwrapping said third portion of said tensile member whereupon said unwrapping is arrested by said coupling of said second portion of said tensile member to said spool.

* * * * *

UNITED STATES PATENT AND TRADEMARK OFFICE

CERTIFICATE OF CORRECTION

PATENT NO. : 8,079,570 B2
APPLICATION NO. : 12/220814
DATED : December 20, 2011
INVENTOR(S) : Bu Qin Ruan It is certified that error appears in the above-identified patent and that said Letters Patent is hereby corrected as shown below:

Title page, should read,

(63) Continuation of application No. 10/906,700, filed on Mar. 2, 2005, now Pat. No. 7,513,452.

Signed and Sealed this
Sixth Day of March, 2012

David J. Kappos

David J. Kappos
*Director of the United States Patent and Trademark Office*